US007715575B1

(12) United States Patent
Sakurai et al.

(10) Patent No.: US 7,715,575 B1
(45) Date of Patent: May 11, 2010

(54) ROOM IMPULSE RESPONSE

(75) Inventors: Atsuhiro Sakurai, Tsukuba (JP); Steven David Trautmann, Tsukuba (JP)

(73) Assignee: Texas Instruments Incorporated, Dallas, TX (US)

( * ) Notice: Subject to any disclaimer, the term of this patent is extended or adjusted under 35 U.S.C. 154(b) by 1054 days.

(21) Appl. No.: 11/364,791

(22) Filed: Feb. 28, 2006

Related U.S. Application Data

(60) Provisional application No. 60/657,234, filed on Feb. 28, 2005, provisional application No. 60/756,045, filed on Jan. 4, 2006.

(51) Int. Cl.
*H04R 5/02* (2006.01)

(52) U.S. Cl. ..... 381/309; 381/300; 381/303; 381/307

(58) Field of Classification Search ..... 381/1, 381/17, 18, 26, 27, 300, 303, 307, 309
See application file for complete search history.

(56) References Cited

U.S. PATENT DOCUMENTS

| | | | | |
|---|---|---|---|---|
| 5,946,400 | A * | 8/1999 | Matsuo | 381/17 |
| 6,741,711 | B1 * | 5/2004 | Sibbald | 381/310 |
| 7,024,259 | B1 * | 4/2006 | Sporer et al. | 700/94 |
| 2005/0117762 | A1 * | 6/2005 | Sakurai et al. | 381/309 |
| 2006/0045294 | A1 * | 3/2006 | Smyth | 381/309 |

* cited by examiner

*Primary Examiner*—Vivian Chin
*Assistant Examiner*—Friedrich Fahnert
(74) *Attorney, Agent, or Firm*—Mirna G. Abyad; Wade J. Brady, III; Frederick J. Telecky, Jr.

(57) ABSTRACT

Audio loudspeaker and headphone virtualizers and methods use room impulse responses with modified individual head-related transfer functions prior to superposition including middle truncation; and perform convolutions in the frequency domain with zero-padded sections to avoid circular convolution overlap.

4 Claims, 6 Drawing Sheets

ROOM IMPULSE RESPONSE

CROSS-REFERENCE TO RELATED APPLICATIONS

This application claims priority from provisional patent application Nos. 60/657,234, filed Feb. 28, 2005 and 60/756,045, filed Jan. 4, 2006. The following co-assigned copending applications disclose related subject matter: Appl. Ser. No.: 11/125,927, filed May 10, 2005.

BACKGROUND OF THE INVENTION

The present invention relates to digital audio signal processing, and more particularly to artificial room impulse responses for virtualization devices and methods.

Multi-channel audio is an important feature of DVD players and home entertainment systems. It provides a more realistic sound experience than is possible with conventional stereophonic systems by roughly approximating the speaker configuration found in movie theaters. FIG. 2*b* illustrates an example of 5-channel audio processing known as "virtual surround" which consists of creating the illusion of a 5-channel speaker system using a conventional pair of loudspeakers. This technique makes use of the impulse responses (time domain) or transfer functions (frequency domain) from each virtual loudspeaker to a listener's ears; these are the head-related impulse responses (HRIRs) or head-related transfer functions (HRTFs) and depend upon the angles and distance between the speaker and the facing direction of the listener.

By including HRIRs/HRTFs of paths with reflections and attenuations in addition to the direct path from a (virtual) speaker to a listener's ear, the virtual listening environment can be controlled. Such a combination of HRIRs/HRTFs gives a room impulse response or transfer function. A room impulse response is largely unknown, but the direct path HRTFs can be approximated by use of a library of measured HRTFs. For example, Gardner, Transaural 3-D Audio, MIT Media Laboratory Perceptual Computing Section Technical Report No. 342, Jul. 20, 1995, provides HRTFs for every 5 degrees (azimuthal). Then an artificial room impulse response/transfer function can be generated by the superposition of HRIRs/HRTFs corresponding to multiple reflection paths of the sound wave in a virtual room environment together with factors for absorption and phase change upon virtual wall reflections. A widely accepted method for simulating room acoustics called the "image method" can be used to determine a set of angles and distances of virtual speakers corresponding to wall reflections. Each virtual speaker (described by its angle and distance) can be associated with an HRIR (or its corresponding HRTF) attenuated by an amount that depends on the distance and number of reflections along its path. Therefore, the room impulse response corresponding to a speaker and its wall reflections can be obtained by summing the HRIR corresponding to the location of the original speaker with respect to the listener and the HRIRs corresponding to locations imaged by wall reflections. As the distance and number of reflections increase, the corresponding HRIR suffers a stronger attenuation that causes the room impulse response to decay slowly towards the end. An example of a room impulse response generated using this method is shown in FIG. 2*h*.

The signal processing can be more explicitly described as follows. FIG. 2*e* shows functional blocks of the 2-speaker implementation for the 5-channel arrangement of FIG. 2*b*; this implementation requires cross-talk cancellation for the real speakers which appears in the lower right block in FIG. 2*e*. Here cross-talk denotes the signal from the right speaker that is heard at the left ear and vice-versa. The basic solution to eliminate cross-talk was proposed in U.S. Pat. No. 3,236,949 and is explained as follows. Consider a listener facing two loudspeakers as shown in FIG. 2*a*. Let $X_1(e^{j\omega})$ and $X_2(e^{j\omega})$ denote the (short-term) Fourier transforms of the analog signals which drive the left and right loudspeakers, respectively, and let $Y_1(e^{j\omega})$ and $Y_2(e^{j\omega})$ denote the Fourier transforms of the analog signals actually heard at the listener's left and right ears, respectively. Presuming a symmetrical speaker arrangement, the system can then be characterized by two HRTFs, $H_1(e^{j\omega})$ and $H_2(e^{j\omega})$, which respectively relate to the short and long paths from speaker to ear; that is, $H_1(e^{j\omega})$ is the transfer function from left speaker to left ear or right speaker to right ear, and $H_2(e^{j\omega})$ is the transfer function from left speaker to right ear and from right speaker to left ear. This situation can be described as a linear transformation from $X_1$, $X_2$ to $Y_1$, $Y_2$ with a 2×2 matrix having elements $H_1$ and $H_2$:

$$\begin{bmatrix} Y_1 \\ Y_2 \end{bmatrix} = \begin{bmatrix} H_1 & H_2 \\ H_2 & H_1 \end{bmatrix} \begin{bmatrix} X_1 \\ X_2 \end{bmatrix}$$

Note that the dependence of $H_1$ and $H_2$ on the angle that the speakers are offset from the facing direction of the listener has been omitted.

FIG. 3 shows a cross-talk cancellation system in which the input electrical signals (short-term Fourier transformed) $E_1(e^{j\omega})$, $E_2(e^{j\omega})$ are modified to give the signals $X_1$, $X_2$ which drive the loudspeakers. (Note that the input signals $E_1$ $E_2$ are the recorded signals, typically recorded using either a pair of moderately-spaced omni-directional microphones or a pair of adjacent uni-directional microphones with an approximately 60 degree angle between the two microphone directions.) This conversion from $E_1$, $E_2$ into $X_1$, $X_2$ is also a linear transformation and can be represented by a 2×2 matrix. If the target is to reproduce signals $E_1$, $E_2$ at the listener's ears (so $Y_1=E_1$ and $Y_2=E_2$) and thereby cancel the effect of the cross-talk (due to $H_2$ not being 0), then the 2×2 matrix should be the inverse of the 2×2 matrix having elements $H_1$ and $H_2$. That is, taking $$\begin{bmatrix} X_1 \\ X_2 \end{bmatrix} = \begin{bmatrix} H_1 & H_2 \\ H_2 & H_1 \end{bmatrix}^{-1} \begin{bmatrix} E_1 \\ E_2 \end{bmatrix} = \frac{1}{H_1^2 - H_2^2} \begin{bmatrix} H_1 & -H_2 \\ -H_2 & H_1 \end{bmatrix} \begin{bmatrix} E_1 \\ E_2 \end{bmatrix}$$

yields $Y_1=E_1$ and $Y_2=E_2$.

Of course, the implementation of such filters would require considerable dynamic range reduction in order to avoid saturation about frequencies with response peaks. For example, with two real speakers each 30 degrees offset as in FIG. 2*a*, the log magnitude of $$\frac{1}{H_1^2 - H_2^2}$$

has the form illustrated by FIG. 2*g*. The range is from 0 Hz to 24000 Hz sampled every 93.75 Hz (using an FFT length of 512). The gain has been scaled so that the minimum gain is 1.0 (0 dB on the log scale). Note the large peak near 8000 Hz (near bin 90). This large peak in turn limits the available dynamic range.

For example, the left surround sound virtual speaker could be at an azimuthal angle of about 225 degrees. Thus with cross-talk cancellation, the corresponding two real speaker inputs to create the virtual left surround sound speaker would be:

$$\begin{bmatrix} X_1 \\ X_2 \end{bmatrix} = \frac{1}{H_1^2 - H_2^2}\begin{bmatrix} H_1 & -H_2 \\ -H_2 & H_1 \end{bmatrix}\begin{bmatrix} TF3_{left} \cdot LSS \\ TF3_{right} \cdot LSS \end{bmatrix}$$

where $H_1$, $H_2$ are for the left and right real speaker angles (e.g., 30 and 330 degrees), LSS is the (short-term Fourier transform of the) left surround sound signal, and $TF3_{left}=H_1(225)$, $TF3_{right}=H_2(225)$ are the HRTFs for the left surround sound speaker angle (225 degrees).

Again, FIG. 2*e* shows functional blocks for a virtualizer with the cross-talk canceller to implement 5-channel audio with two real speakers as in FIG. 2*b*; each channel signal is filtered by the corresponding pair of HRTFs for the corresponding (virtual) speaker's offset angle and distance, and the filtered signals summed and input into the cross-talk canceller and the two cross-talk-cancelled outputs then drive the two real speakers.

In the case of headphones, the cross-talk problem disappears, and the filtered channel signals can directly drive the headphones as shown in FIGS. 2*c* and 2*f*. Also, FIG. 2*d* illustrates an approximate symmetry between forward and rear speaker locations.

Generally in multi-channel audio processing, the filtering with HRIRs or HRTFs and/or room impulse responses takes the form of many convolutions of input audio signals with long filters. Typically, a room impulse response from each (virtual) sound source to each ear is used. Since an artificial room impulse response can be several seconds long, this poses a challenging computational problem even for fast digital signal processors. Further, artificial room impulse responses need to be corrected in terms of spectral characteristics due to coloration effects introduced by HRIR filters. And external equalizers would involve additional computational overhead and possibly disrupt phase relations that are important in 3D virtualization systems.

One approach to lowering computational complexity of the filtering convolutions first transforms the input signal and the filter impulse response into the frequency domain (as by FFT) where the convolution transforms into a pointwise multiplication and then inverse transforms the product back into the time domain (as by IFFT) to recover the convolution result. The overlap-add method uses this approach with 0 padding prior to FFT to avoid circular convolution feedback. Further, for filtering with a long impulse response, the impulse response can be sectioned into shorter filters and the filtering (convolution) by each filter section separately computed and the results added to give the overall filtering output.

SUMMARY OF THE INVENTION

The present invention provides artificial room impulse responses of the form of a superposition of HRIRs with individually modified HRIRs, and/or with omission of the large-delay contra-lateral portions of the responses, and/or with low computational complexity convolution by truncation of middle sections of the response, and/or by Fourier transform with simplified 0 padding for overlap-add.

DESCRIPTION OF THE PREFERRED EMBODIMENTS

1. Overview

Figure 1A:
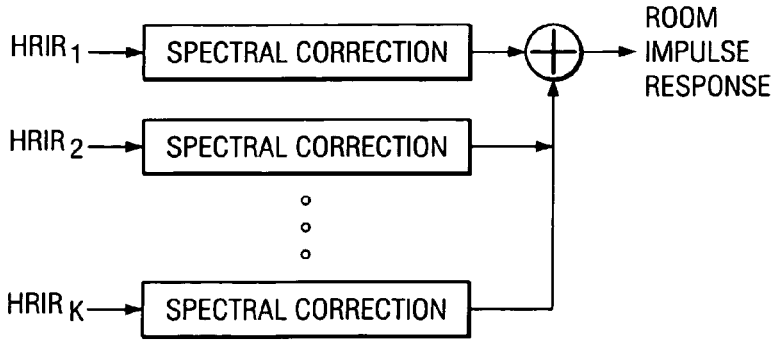
FIGS. 1*a*-1*d* show filters and method flow diagrams.
Figure 1B:
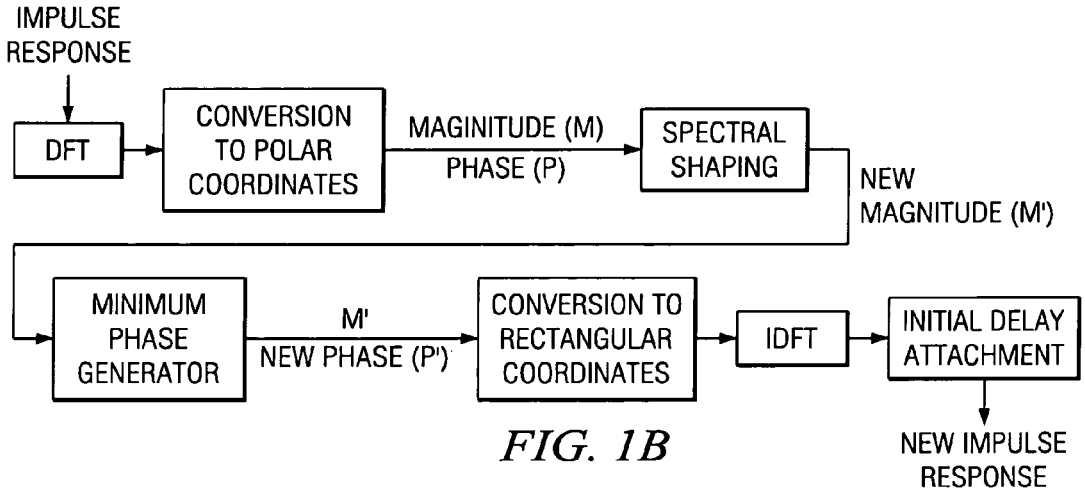
Figure 3:
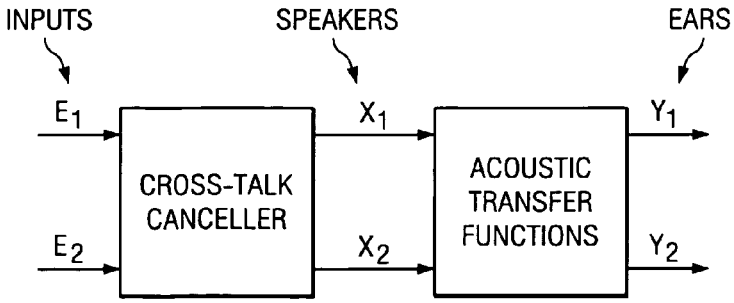
FIG. 3 (PRIOR ART)
FIG. 3 is a cross-talk cancellation system.

Preferred embodiments modify artificial room impulse responses (in the form of a superposition of direct path HRIR plus reflective path attenuated HRIRs) by individual HRIR adjustments prior to superposition; FIGS. 1*a*-1*b* illustrate functional blocks. Further preferred embodiments lower computational complexity by omission of large-delay contra-lateral portions of room impulse responses and/or truncation of middle sections of the responses.

Preferred embodiment systems (e.g., audio/visual receivers, DVD players, digital television sets, etc.) perform preferred embodiment methods with any of several types of hardware: digital signal processors (DSPs), general purpose programmable processors, application specific circuits, or systems on a chip (SoC) such as combinations of a DSP and a RISC processor together with various specialized programmable accelerators such as for FFTs and variable length coding (VLC). A stored program in an onboard or external flash EEPROM or FRAM could implement the signal processing.

2. Modification of Room Impulse Response

The first preferred embodiments allow direct manipulation of an artificial room impulse response off-line during or after its generation. Manipulating the spectrum of a long impulse response is only possible with careful consideration on the magnitude-phase relations that must hold for real, causal systems (Hilbert relations). Methods exist that permit inferring the phase spectrum of an arbitrary magnitude spectrum for particular situations such as minimum, linear, or maximum-phase systems. However, in this case the phase spectrum of the room impulse response must keep its original temporal structure, at least in terms of temporal envelope, which is the basis of the perceived reverberation effect.

FIGS. 1*a*-1*b* illustrate a first preferred embodiment. The method consists of conducting spectral modification on each HRIR (FIG. 1*b*) prior to its superposition to form the room impulse response (FIG. 1*a*). The spectral modification block described in FIG. 1*b* consists of introducing changes in the magnitude spectrum before the calculation of the corresponding minimum phase spectrum. In addition, the initial delay corresponding to the original HRIR path is attached to the beginning of the modified impulse response. The spectral shaping can be done in several ways in the frequency domain by simply manipulating the bins of the magnitude spectrum. For example, a simple bass boost effect can be obtained by adding 6 dB at the first ⅛ bins of the magnitude spectrum.

More explicitly, let RIR(.) denote an artificial room impulse response from a sound source to a listener's ear, and presume RIR has the form of a sum of HRIRs corresponding to the direct plus various reflective paths with attenuations:

$$RIR() = \Sigma_{1 \leqq i \leqq K} \mathrm{HRIR}_i()$$

Figure 2A:
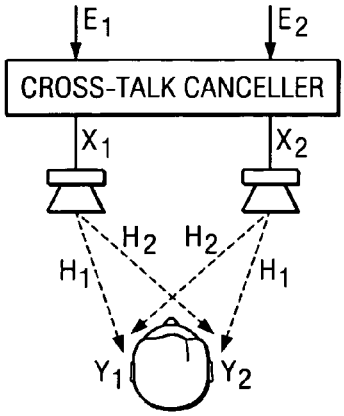
FIG. 2A (PRIOR ART)
FIGS. 2*a*-2*j* illustrate head-related acoustic transfer function and virtualizer geometries and room impulse response.
Figure 2B:
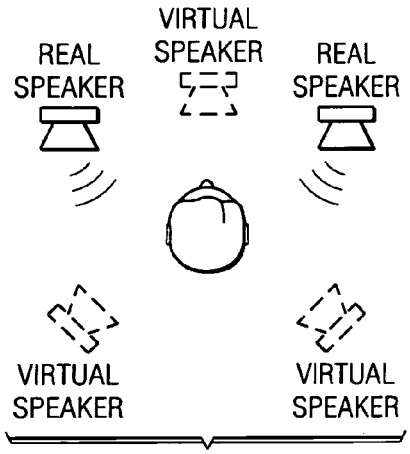
FIG. 2B (PRIOR ART)
Figure 2C:
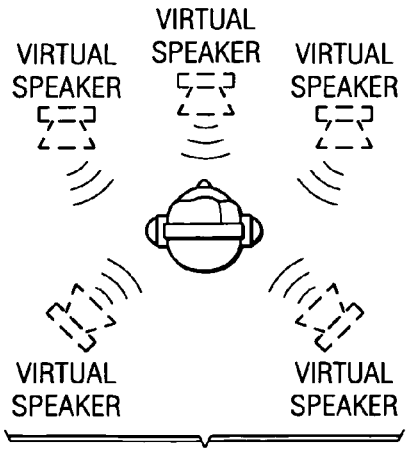
FIG. 2C (PRIOR ART)
Figure 2D:
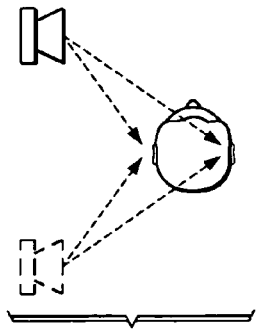
FIG. 2D (PRIOR ART)
Figure 2E:
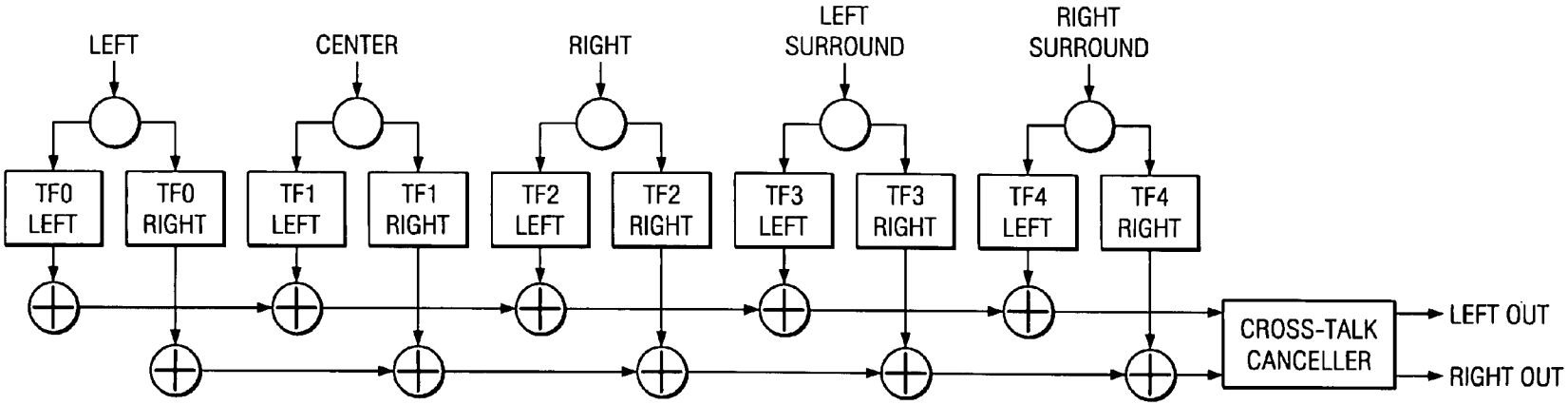
Figure 2F:
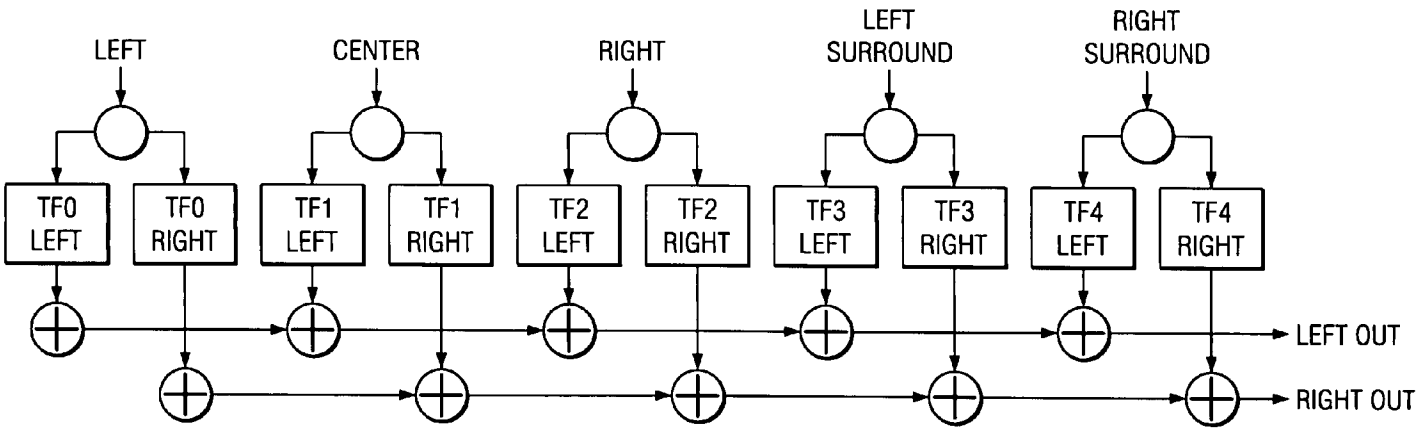
Figure 2G:
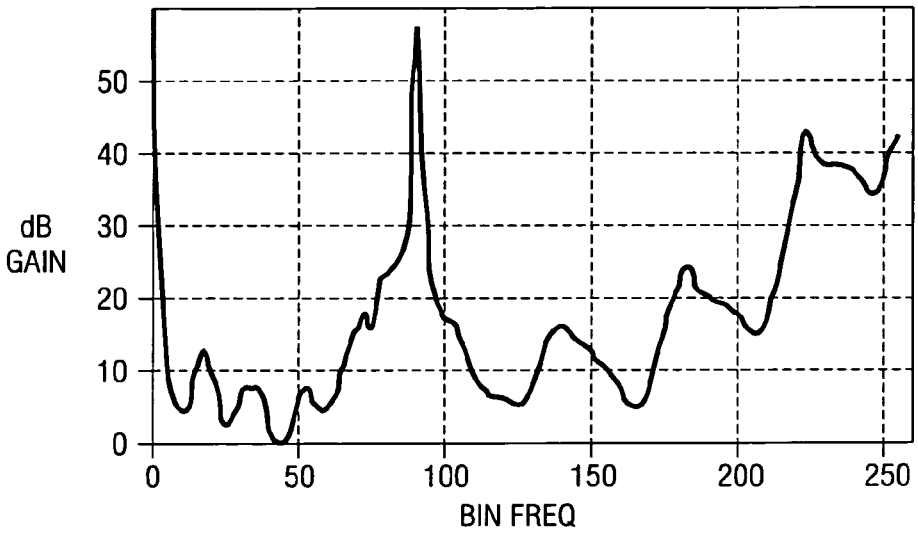
FIG. 2G (PRIOR ART)
Figure 2H:
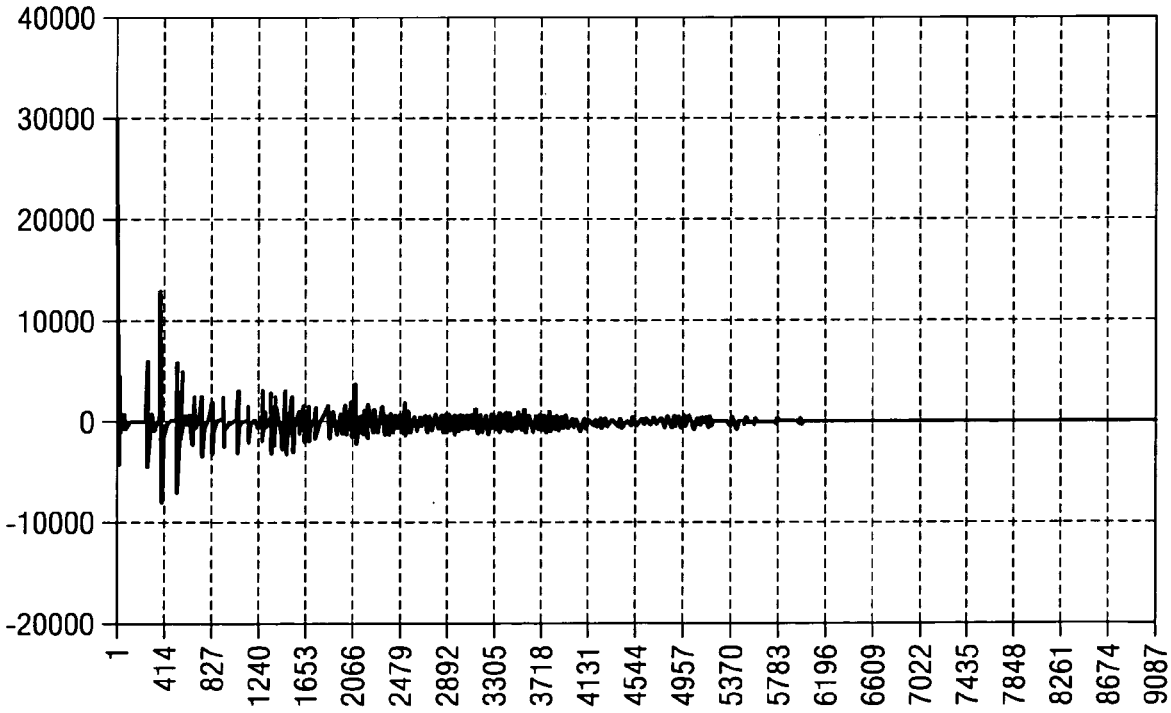
FIG. 2H (PRIOR ART)

The summation index i labels the paths considered, and each HRIR(.) typically has only a few non-zero filter coefficients which are offset from 0 according to the delay along the path from source to ear. Indeed, the spikes visible in the lefthand portion of FIG. 2*h* indicate individual reflective paths.

Then modify each HRIR to correct for spectral coloration as in FIG. 1*b*. For example, presume $HRIR_i(n)=0$ for $n<D_i$ and $n \geqq D_i+L$; that is, the impulse response has length L and an onset delay of $D_i$. For notational convenience, take $h_i(n)=HRIR_i(n+D_i)$ and after spectral modification of $h_i(n)$ the delay is restored to get the spectrally modified $HRIR_i(n)$. Now the spectral modification can be done offline, and thus $h_i(n)$ can be treated as either a finite sequence or an infinite sequence with only a finite number of nonzero coefficients. For the infinite sequence approach the z-transform $H_i(z)$ is used and values on the unit circle are the Fourier transform; i.e., $H_i(e^{j\omega})$. In magnitude-phase representation: $H_i(z)=|H_i(z)|\exp(\arg[H_i(z)])$. Thus, modify the spectral magnitude (e.g., boost the bass) by multiplying $|H_i(e^{j\omega})|$ by a function of ω (e.g., 2 for $|\omega|<\pi/8$ and 1 elsewhere) to give $|H_{i\text{-}mod}(e^{j\omega})|$. Then the corresponding minimum phase is computed as:

$$\arg[H_{i\text{-}mod}(e^{j\omega})]=(1/2\pi)\int_{-\pi<\theta<\pi}\log|H_{i\text{-}mod}(e^{j\theta})|\cot[(\theta-\omega)/2]d\theta$$

And then inverse transform $H_{i\text{-}mod}(e^{j\omega})$ to get $h_{i\text{-}mod}(n)$. Of course $h_{i\text{-}mod}(n)$ is minimum-phase by construction and thus packs most energy into the lowest coefficients, but $h_{i\text{-}mod}(n)$ may have an infinite number of nonzero coefficients and can be truncated.

The alternative is to let $H_i(k)$ be the N-point FFT of $h_i(n)$ where N is at least 2L (the factor of 2 is a "causality" condition for finite length (or periodic) sequences). Then perform the desired spectral modification of $|H_i(k)|$, such as a bass boost by increasing $|H_i(k)|$ by 6 dB for $0 \leqq k<N/8$. Denote this bass boosted spectral magnitude by $|H_{i\text{-}boost}(k)|$. An approximate minimum-phase for the bass-boosted spectrum can then be defined in terms of $\log|H_{i\text{-}boost}(k)|$; namely, the phase is taken as the FFT of the product of the IFFT of $\log|H_{i\text{-}boost}(k)|$ with the unit step:

$$\arg H_{i\text{-}boost}(k)=FFT\{u(n)IFFT[\log|H_{i\text{-}boost}(k)|]\}$$

where $$\begin{aligned} u(n) &= 2 \text{ for } 1 \le n < N/2 \\ &= 1 \text{ for } n = 0, N/2 \\ &= 0 \text{ for } N/2 < n < N \end{aligned}$$

Lastly, the delay $D_i$ is attached; see FIG. 1*b*.

Compared with performing separate equalization, an obvious advantage of the first preferred embodiment is that the processing is performed off-line, resulting in higher computational efficiency. In addition, the present method avoids possible phase disruptions caused by external equalizers that could severely affect the virtualization effect.

On the other hand, modifying the room impulse response after its generation requires careful manipulation of the phase spectrum to maintain the real and causal characteristics of the impulse response. Using a minimum, linear, or maximum-phase spectrum conversion directly on the entire room impulse response is not possible, since the temporal envelope of the impulse response is an important element that cannot be changed. For example, if the entire impulse response is converted into minimum-phase, most of its energy will concentrate at the beginning of the filter, disrupting the temporal structure corresponding to the virtual speakers and their corresponding delays and attenuations.

The preferred embodiment method can successfully modify the magnitude spectrum of the generated impulse response by changing the magnitude spectrum of each HRIR to be overlapped, and also maintain the original envelope of the phase spectrum, since the modified HRIRs are added at the same positions with the same attenuations.

3. Room Impulse Response Convolution Shortening

The second preferred embodiments reduce the number of computations required in frequency-domain convolution of (artificial, modified) room impulse responses by skipping the computation of contra-lateral paths (a path from left side of head to right ear or from right side of head to left ear) for the last few filter sections which results in shorter contra-lateral impulse responses without affecting the resulting quality. This simplification is possible due to the nature of human hearing, which is less sensitive to late reverberation as compared to early arrivals of the sound wave, and to the fact that late reverberation contains little spatial information. Therefore, the trailing portions of room impulse responses do not need to have well-defined ipsi-lateral (path approaching from right side to right ear or from left side to left ear) and contra-lateral impulse responses.

Figure 1C:
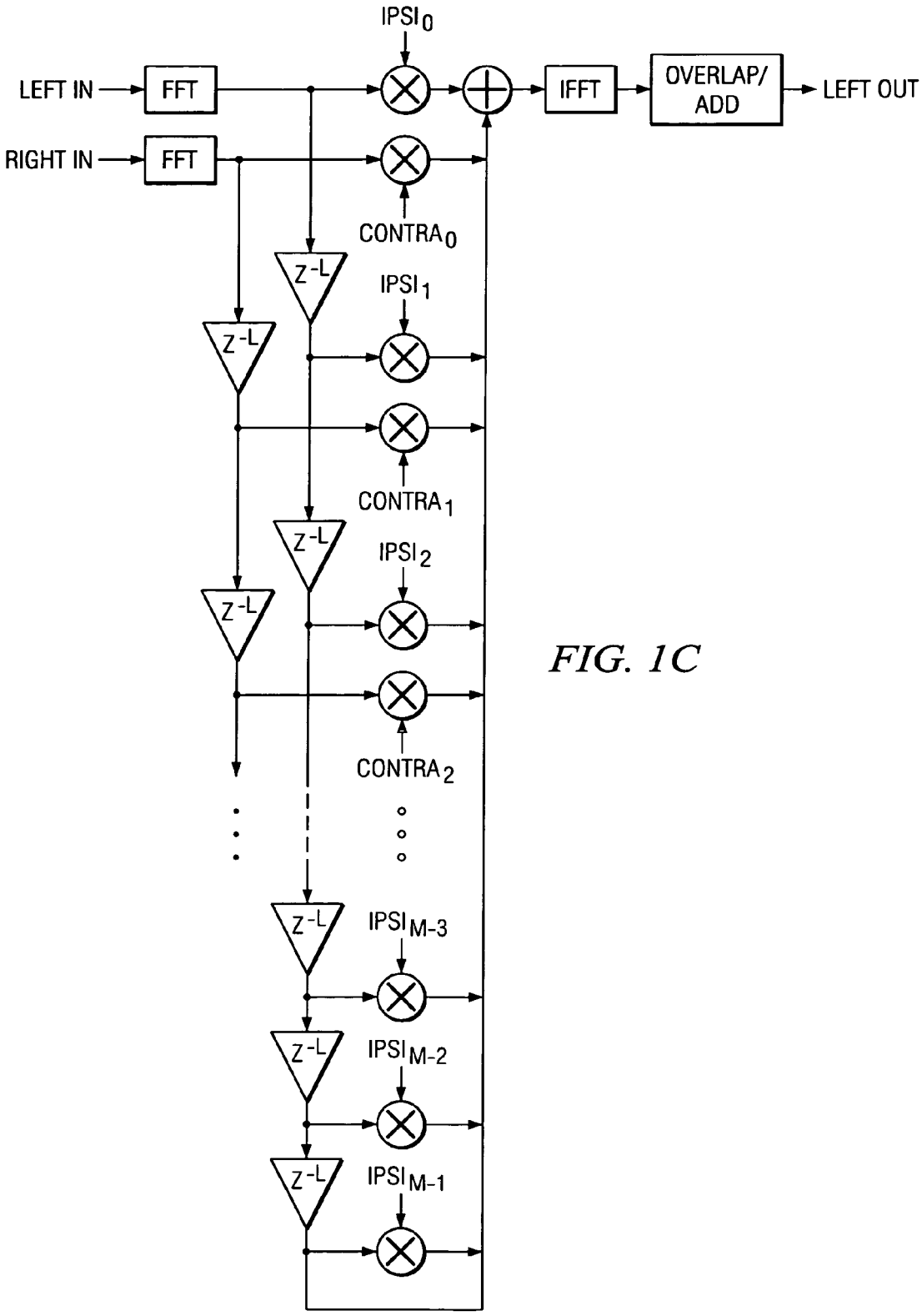
Figure 2I:
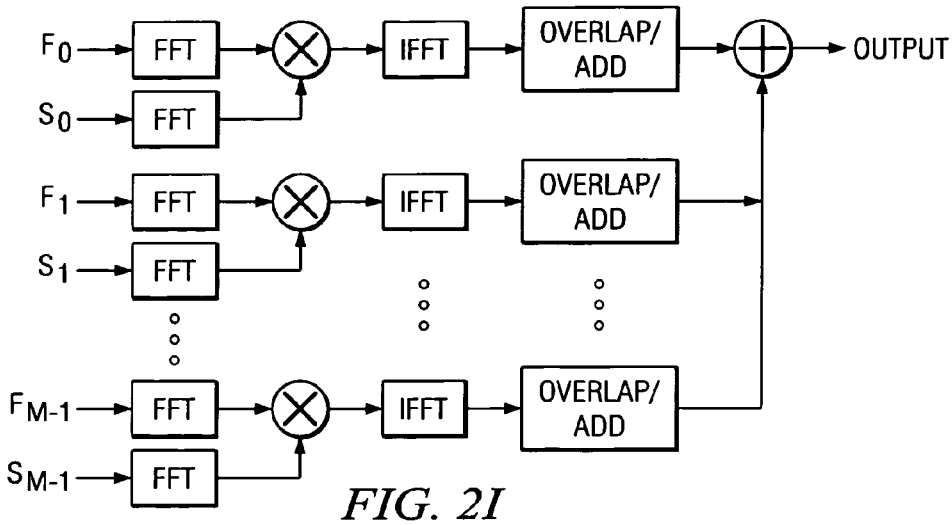
FIG. 2I (PRIOR ART)
Figure 2J:
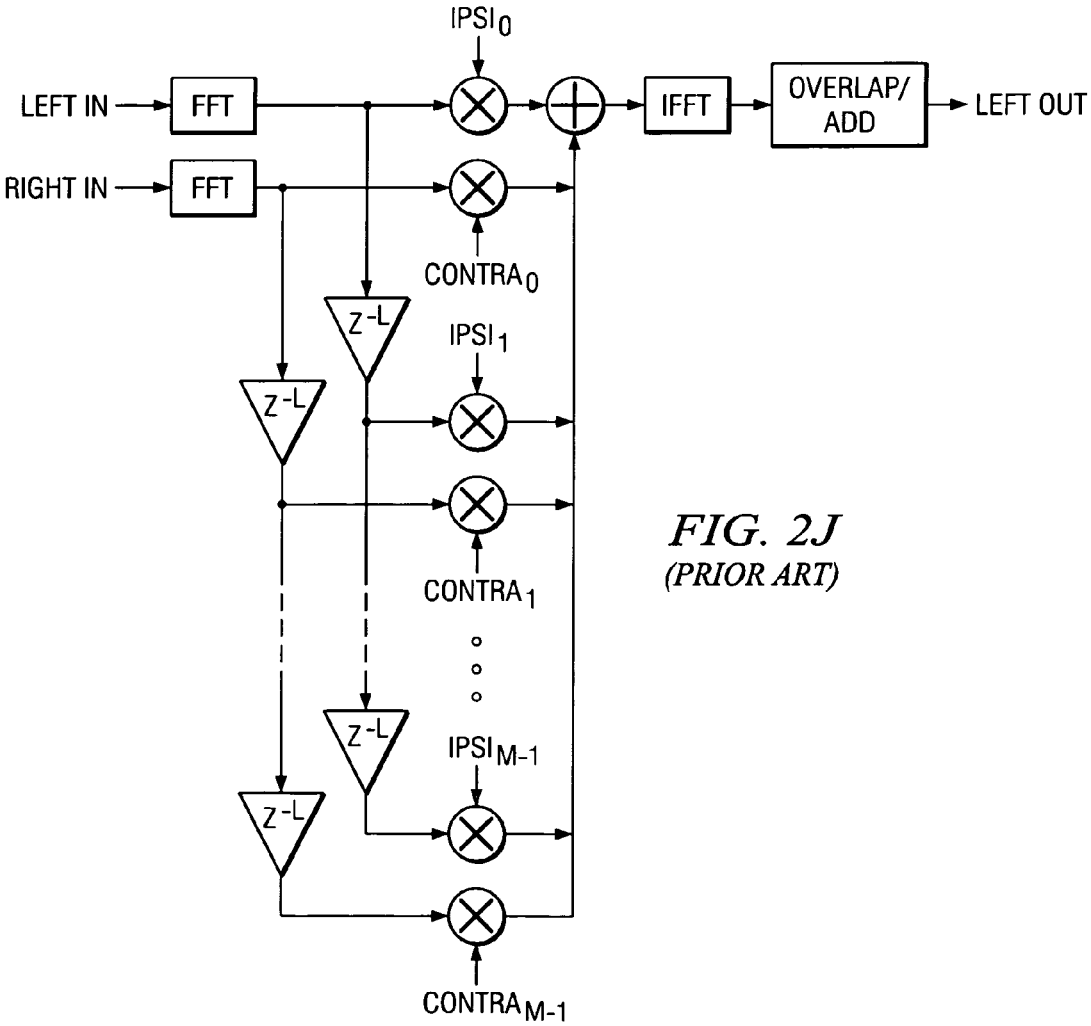
FIG. 2J (PRIOR ART)

FIGS. 2*i*-2*j* and 1*c* illustrate the prior art and the second preferred embodiments as follows. FIG. 2*i* shows filter sectioning into blocks and frequency-domain computations generally; each individual filter section convolution is performed by the overlap-add method: segment at input signal into blocks, transform to frequency domain, pointwise multiply, transform back to time domain, and overlap and add to form the output signal for the filter section. Lastly, the outputs of the filter sections are added. In more detail, presume an input signal s(n) and filter coefficients f(n), the filter output y(n) is the convolution:

$$\begin{aligned} y(n) &= \sum_{0 \le l < L} s(n-l)f(l) \\ &= \sum_{0 \le l < L} s(n-l)\left[\sum_{0 \le m < M} f_m(l)\right] \\ &= \sum_{0 \le m < M} \sum_{0 \le b < B} s(n-b-mB)f_m(b+mB) \end{aligned}$$

where the filter length L is the product of a block size B times the number of filter sections (blocks) M, and the m-th filter section $f_m(n)$ has non-zero coefficients only in the m-th block, $mB \leqq n<(m+1)B$. Typically, the block size is taken as a convenient power of 2 for ease of FFT, such as B=256. Then each of the M convolutions is computed by the steps of: section the input signal into blocks of size B, pad input block and filter section with 0s to size 2B (this avoids circular convolution wrap-around), 2B-point FFT for both input block and filter section (filter section FFT may be precomputed and stored), pointwise multiply transforms, IFFT; and combine the 2B-point results by overlap-add where the overlap is by B samples to give the output of the m-th filter. Lastly, add the M filter outputs. Note that the m-th filter section filtering is equivalent to a length B filter acting on an input signal block which has been delayed by m blocks. That is, $$y_m(n)=\Sigma_{0 \leqq b<B}s(n-b-mB)f_m(b+mB)=\Sigma_{0 \leqq b<B}s_m(n-b)h_m(b)$$

where $h_m(b)=f_m(b+mB)$ has non-zero coefficients only for $0 \leqq b<B$ and $s_m(n)=s(n-mB)$ is a delayed version of s(n). Thus the FFT for the 0-padding input signal block has already been computed.

In FIG. 2*i*, $S_0$ through $S_{M-1}$ are the input audio signal blocks with 0 padding, and $F_0$ through $F_{M-1}$ are the corresponding filter section blocks with 0 padding. The filter in the preferred embodiments is a (modified) room impulse response. Calculation of the FFT for filter coefficients ($F_0$, $F_1, \ldots, F_{M-1}$) can be done off-line. For uniform block-size partitioning, the signals $S_1, \ldots, S_{M-1}$ are respectively equal to the previous values of $S_0, \ldots, S_{M-2}$. Thus, it is not necessary to compute the FFT of $S_1, \ldots, S_{M-1}$ but rather load previously saved data. This scheme can be applied to the room impulse response convolution problem by partitioning the ipsi-lateral and contra-lateral filters into sections and performing signal mixing in the frequency domain prior to the inverse FFT, as shown in FIG. 2*j* (only the process of creating the left output signal is shown).

The second preferred embodiments address the computational issue related to spectral multiplication taking into consideration the peculiarities of room impulse responses and human hearing. It is well known that human hearing is less sensitive to late reverberation as compared to early arrivals of the sound waves, and therefore the late reverberation portion of a room impulse response can be simplified in several ways without affecting the perceptual quality of the sound. This is also true with respect to the spatiality of the sound, which is dictated by the early arrivals of the sound wave. Therefore, the relation of the ipsi-lateral and contra-lateral for the trailing portion of room impulse responses can be modified for better efficiency. As shown in FIG. 1*c* the second preferred embodiments make use of this fact by skipping the multiplication by the contra-lateral filter sections location at the end of the room impulse response. For example, if the original filter has 10 sections and the 8 last contra-lateral sections are skipped, the number of spectral multiplications can be reduced by 40%. FIG. 1*c* illustrates the case where the 3 last filter sections have no contra-lateral paths.

In general, if the room impulse response has L coefficients, then the last 0.2-0.4 L (20-40%) of the coefficients are omitted, depending upon the size of L, with larger L implying a larger fraction of the contra-lateral coefficient omitted.

4. Room Impulse Response Convolution Simplification

Figure 1D:
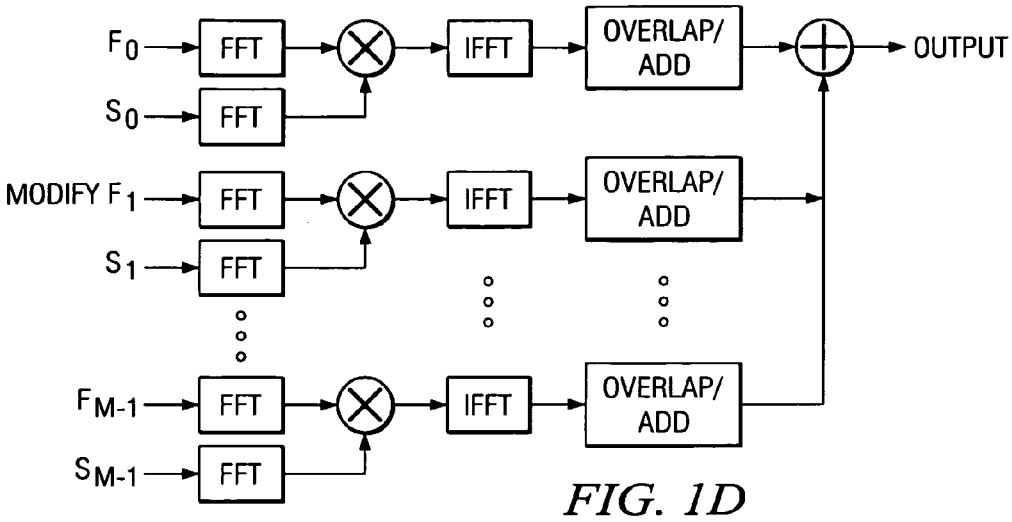

FIG. 1*d* shows the third preferred embodiment methods to reduce the number of computations required in convolution of room impulse responses by modifying the middle portions of the sectioned filter of FIG. 2*i*. Indeed, a room impulse response can be characterized by the pattern of sound reflections that are expected for the particular modeled environment. It is known from psychoacoustics that the human ear is sensitive to the first reflections that arrive after the direct signal, but tends not to distinguish the large number of reflections that occur afterwards; i.e., they are perceived as a collective effect. Therefore, it is expected that the impulse response can be greatly simplified without affecting the output quality.

On the other hand, just shortening the filter as a whole would cause a significant perceptual impact, because the total reverberation duration (i.e., filter length) is an important factor that must be preserved.

The third preferred embodiments use the sectioned filter block convolution approach and simplify intermediate filter sections where temporal structures tend to get masked.

It is worth noting that just shortening a filter section by truncating its trailing portion and applying a multiplicative compensation factor to preserve total energy is not a good solution due to the spectral distortion introduced by the truncation. In order to preserve the spectral shape of intermediate filter sections, the preferred embodiments transform them into minimum phase filters. The reason for this, besides the fact that the magnitude spectrum has the same shape as the original filter section, is that minimum phase filters have the property that their energy is maximally concentrated in the first coefficients and tends to decrease towards the end. Thus, the spectral distortion caused by truncation can be minimized. It is also worth noting that the minimum-phase transformation also produces spectral distortion due to the change in the phase spectrum of individual sections, but that does not represent a problem because phase relations are less important except for the first reflections.

The third preferred embodiment proceeds as: first transforms each of the room impulse response filter sections after the first section into minimum-phase filter by reflecting all the z-transform zeros located outside of the unit circle into zeros inside the unit circle; next, truncate the minimum-phase filters in the time domain; and after truncation, apply a multiplicative factor to correct the energy level of the truncated minimum-phase filter to match the original filter section energy level. FIG. 1*d* illustrates the minimum-phase, truncation, energy level correction as "modify". Note that FIG. 1*d* implicitly presumes that the filter sections all have the same size (equal to the block size). An alternative combines two or more of the filter sections into a single large section prior to the transformation to minimum-phase and truncation plus energy level correction; after truncation and energy level correction, the combined sections can be separated into original size sections. In this case the truncation may result in some filter sections being all 0s. For example, with a block size M=256, the first four filter sections (1024 coefficients representing ~20 ms at 48 kHz sampling) are left unchanged; the next eight sections are combined into a single 2048 coefficient filter for conversion to minimum-phase and truncated to 512 coefficients; the next sixteen sections are combined into a single 4096 coefficient filter for conversion to minimum-phase and truncation to 1024 coefficients; and the last 1024 coefficients are left unchanged in order to maintain the overall filter length. The eight sections combined and truncated give two non-zero sections followed by six sections with all 0 coefficients, and the sixteen sections combined and truncated gives four non-zero sections followed by twelve sections with all 0 coefficients. Then this modified room impulse response is used as shown in FIG. 1*d* with the FFTs for the modified room impulse response filter sections precomputed and stored.

More explicitly, convert a filter section (or combined filter sections) to a minimum-phase filter by convolving with an allpass filter determined by the zeros of the filter transfer function which lie outside of the unit circle. Indeed, let h(n) for $0 \leqq n<N$ be a filter to convert to a minimum-phase filter, $h_{min}(n)$. As with the first preferred embodiments, h(n) can be considered as an infinite sequence with a finite number of nonzero coefficients or as a finite (or periodic) sequence. The infinite sequence approach gives an exact $h_{min}(n)$ which may have an infinite number nonzero coefficients but is truncated anyway, and the finite sequence approach gives an approximate $h_{min}(n)$. For the infinite sequence approach, initially compute the transfer function H(z); then find an allpass filter with transfer function $H_{allpass}(z)$ so that $H(z)=H_{min}(z)H_{allpass}(z)$. To determine $H_{allpass}(z)$, first find the zeros of H(z) which lie outside of the unit circle, and then for each such zero (e.g., $H(\alpha)=0$ for $1<|\alpha|$) include the bilinear factor $(z^{-1}-\alpha^{-1})/(1-(\alpha^{-1})^*z^{-1})$ in $H_{allpass}(z)$ (note that * indicates complex conjugate). That is, compute $H_{min}(z)=H(z)\,\Pi\,(1-(\alpha^{-1})^*z^{-1})/(z^{-1}-\alpha^{-1})$ where the product is over the zeros of H(z) outside of the unit circle. Next, inverse z-transform to recover $h_{min}(n)$. Then, truncate and correct the energy level to get $h_{min\text{-}trun}(n)$. Lastly, 0 pad (each section if combined filter sections) and compute the FFT for use in the architecture of FIG. 1*d*.

5. Zero-padding with FFT

Fourth preferred embodiments reduce the computational complexity of the FFT after 0-padding used in the overlap-add method of filtering by multiplication in the frequency domain, and thus can be applied to the foregoing preferred embodiments. In particular, let x(n) for $0 \leqq n < N$ be 0 padded to define $x_{pad}(n)$ for $0 \leqq n < 2N$ as $$\begin{aligned} x_{pad}(n) &= x(n) \quad \text{for } 0 \le n < N \\ &= 0 \quad \text{for } N \le n < 2N \end{aligned}.$$

Then the 2N-point FFT of $x_{pad}(n)$ is:

$$\begin{aligned} X_{pad}(k) &= \sum_{0 \le n < 2N} x_{pad}(n) e^{-j2\pi kn/2N} \\ &= \sum_{0 \le n < N} x(n) e^{-j2\pi kn/2N} \\ &= \sum_{0 \le n < N} \left[ (1/N) \sum_{0 \le i < N} X(i) e^{j2\pi in/N} \right] e^{-j2\pi kn/2N} \end{aligned}$$

where the N-point inverse FFT expression for x(n) was substituted. Now rearranging:

$$X_{pad}(k)=(1/N)\Sigma_{0 \leqq i < N} X(i) \Sigma_{0 \leqq n < N} e^{-j2\pi n(k/2-i)/N}$$

Consider the case of k an even integer: k=2m. In this case:

$$\begin{aligned} \sum_{0 \le n < N} e^{-j2\pi n(k/2-i)/N} &= \sum_{0 \le n < N} e^{-j2\pi n(m-i)/N} \\ &= N\delta_{m-i} \end{aligned}$$

so $$\begin{aligned} X_{pad}(2m) &= (1/N) \sum_{0 \le i < N} X(i) N \delta_{m-i} \\ &= X(m) \end{aligned}$$

Thus the even frequencies of the zero-padded spectrum can be computed as the frequencies of the non-zero-padded spectrum at one-half the frequency. That is, an N-point FFT of x(n) generates the even frequencies of the 2N-point FFT of $x_{pad}(n)$.

For the odd frequencies of the zero-padded spectrum, take k=2m+1 in the foregoing:

$$\begin{aligned} X_{pad}(2m+1) &= (1/N) \sum_{0 \le i < N} X(i) \sum_{0 \le n < N} e^{j2\pi n(i-(2m+1)/2)/N} \\ &= (1/N) \sum_{0 \le i < N} X(i) \sum_{0 \le n < N} e^{-j\pi n/N} e^{j2\pi n(i-m)/N} \\ &= (1/N) \sum_{0 \le i < N} X(i) S(m-i) \end{aligned}$$

which is a circular convolution in the frequency domain where $$S(k)=\Sigma_{0 \leqq n < N} e^{-j\pi n/N} e^{-j2\pi nk/N}$$

is the N-point FFT of $s(n)=e^{-j\pi n/N}$ and extended by periodicity to negative k. Thus the odd frequencies of the zero-padded spectrum are computed in terms of a convolution with the N-point FFT of x(n).

For notational convenience, define $Y(m)=X_{pad}(2m+1)$, then taking the N-point inverse FFT gives:

$$\begin{aligned} y(n) &= (1/N) \sum_{0 \le m < N} Y(m) e^{j2\pi mn/N} \\ &= (1/N) \sum_{0 \le m < N} (1/N) \sum_{0 \le i < N} X(i) S(m-i) e^{j2\pi mn/N} \\ &= x(n) s(n) \end{aligned}$$

Thus to compute the odd frequencies of $X_{pad}(k)$ in the frequency domain by convolution, the fastest way is to move back to the time domain, producing the original sequence x(n) and a complex exponential ($e^{-j\pi n/N}$) to pre-warp the FFT to look at the odd frequencies, multiplying point-wise, and taking the FFT of the result to get back to the frequency domain and the odd frequencies. Since the original sequence is available and the s(n) can be pre-calculated, all that is required is point-wise multiplication and a forward FFT to obtain the odd frequencies directly.

In short, the fourth preferred embodiment zero-padded 2N-point FFT requires two N-point FFTs and N complex multiplies instead of one 2N-point FFT. However, half of the complex multiplies in the time domain can be combined with twiddle factors in the first stage of many FFT implementations, so only an additional N/2 complex multiplies are required. Hence, about 3N/2 operations can potentially be saved.

An alternative fourth preferred embodiment method approximates the terms in the definition of S(m) to simplify the frequency-domain convolution computation. In particular, $$\begin{aligned} S(k) &= \sum_{0 \le n < N} e^{-j\pi n/N} e^{-j2\pi nk/N} \\ &= \sum_{0 \le n < N} \cos[\pi n(2k+1)/N] - j \sin[\pi n(2k+1)/N] \end{aligned}$$

Note that if n=0, then $\cos[\pi n(2k+1)/N]=1$ and for all other n the cosine is anti-symmetric about N/2: $\cos[\pi n(2k+1)/N]=-\cos[\pi(N-n)(2k+1)/N]$. And if N is even, n=N/2 gives $\cos[\pi n(2k+1)/N]=0$. Thus all the cosine terms except n=0 cancel in the summation. In contrast, the sine is symmetric about N/2, so only the n=0 term can be omitted. And thus separating the n=0 terms out of the sum defining S(k) gives:

$$Y(m)=(1/N)\Sigma_{0 \leqq i < N} X(i)+(-j/N)\Sigma_{1 \leqq i < N} X(i) T(m-i)$$

where $$T(k)=\Sigma_{1 \leqq n < N} \sin[\pi n(2k+1)/N]$$

Since T(k) is real-valued and anti-symmetric, it can be thought of as a linear-phase filter which is cyclically convolved with X(k). The first sum in Y(m) needs to be computed only once. However, the convolution needs to be calculated for each m, requiring $O(N^2)$ operations to calculate all Y(m). The preferred embodiment methods approximate the convolution with far fewer computations by windowing or other modification of the filter kernel.

Initially, consider the computational simplification in terms of operations. Presume a 2N-point FFT requires $K(2N\log_2(2N))$ operations and an N-point FFT requires $K(N\log_2(N))$ operations. If 2NM operations are required to compute the convolution directly (for a filter kernel with M non-zero coefficients), then to save computation requires $$2NM<K(2N\log_2(2N))-K(N\log_2(N))-N$$

where the first term on the right is the direct 2N-point FFT complexity to get $X_{pad}(k)$, the second term is the N-point FFT complexity to get X(k), and the last term is $(1/N)\Sigma_{0\leq i<N}X(i)$ for the non-convolution term of Y(m). This implies $$2M<K\log_2(N)+2K-1$$

For example, with N=8192 and K=4 then M<29.5 is needed to save computation.

Once the length (M) of the filter kernel has been set, the next step is to create the kernel. This is equivalent to a filter design problem. Perhaps the simplest approach is to truncate the original kernel. A graph of T(k) shows that coefficients near k=0 dominate, and coefficients near k=N/2 have small magnitudes. Hence, define a truncated version of T(k):

$$T_{trun}(k)=T(k)\quad \text{for } M/2\leq k<M/2$$
$$=0\qquad \text{otherwise}$$

Alternatively, multiplication with a window function, such as a Hann window, can similarly reduce the number of nonzero filer coefficients but with a smoother transition in filter coefficient magnitude. Of course, other filter design methods could be used to approximate T(k) by a filter with a small number of nonzero filter coefficients.

6. Modifications

The preferred embodiments can be modified in various ways; for example, vary the sizes of blocks of samples, vary the size of FFTs, vary the sizes of filter partitions, truncate more or less of filter sections, use other spectrum modifications such as tapering, and so forth.

What is claimed is:

1. A method of a circuit device of room impulse response processing, comprising the steps of:

(a) forming, in the circuit device, a room impulse response as a superposition of a plurality of head-related impulse responses with each of said head-related impulse responses having an initial delay and each of said head-related impulse responses being either an ipsi-lateral or a contra-lateral impulse response;

(b) wherein said superposition includes at least one ipsi-lateral impulse response with initial delay greater than all of said initial delays of said contra-lateral impulse responses.

2. The method of claim 1, wherein said superposition includes at least twice as many ipsi-lateral impulse responses as contra-lateral impulse responses.

3. A stereo audio device, comprising:

(a) inputs for digital stereo audio signals;

(b) filters coupled to said inputs, said filters corresponding to convolution with a superposition of head-related impulse responses with initial delays; and (c) outputs coupled to said filters;

(d) wherein said head-related impulse responses have an initial delay and each of said head-related impulse responses is either an ipsi-lateral or a contra-lateral impulse response, and said superposition includes at least one ipsi-lateral impulse response with initial delay greater than all of said initial delays of said contra-lateral impulse responses.

4. A method of a circuit unit for room impulse response processing, comprising the steps of:

(a) partitioning, in the circuit unit, a room impulse response into filter sections $f_0, f_1, f_2, \ldots, f_{M-1}$; where M is an integer greater than 2;

(b) converting filter section $f_m$ into a minimum-phase filter $f_{m\text{-}min}$ for at least one m with 0<m<M−1;

(c) truncating said filter $f_{m\text{-}min}$ to yield filter $f_{m\text{-}min\text{-}trun}$; and (d) replacing said $f_m$ in said room impulse response with said $f_{m\text{-}min\text{-}trun}$ to yield a modified room impulse response.

* * * * *